US005578094A

United States Patent [19]

Brooker et al.

[11] Patent Number: 5,578,094

[45] Date of Patent: Nov. 26, 1996

[54] VANADIUM ADDITION TO PETROLEUM COKE SLURRIES TO FACILITATE DESLAGGING FOR CONTROLLED OXIDATION

[75] Inventors: D. Duane Brooker, Hopewell Junction, N.Y.; James S. Falsetti, New Fairfield, Conn.

[73] Assignee: Texaco Inc., White Plains, N.Y.

[21] Appl. No.: 365,219

[22] Filed: Dec. 8, 1994

[51] Int. Cl.[6] ..... C10J 3/46

[52] U.S. Cl. ..... 48/197 R; 48/203; 48/206; 48/210; 48/DIG. 2

[58] Field of Search ..... 48/197 R, 203, 48/206, 210, 212, 215, DIG. 2; 252/373; 110/165 R, 171; 266/45

[56] References Cited

U.S. PATENT DOCUMENTS

| | | | |
|---|---|---|---|
| 2,914,418 | 11/1959 | Eastman | 48/215 |
| 2,932,561 | 4/1960 | Paull | 48/215 |
| 2,976,135 | 3/1961 | Eastman | 48/215 |
| 3,069,251 | 12/1962 | Eastman | 48/215 |
| 3,607,157 | 9/1971 | Schlinger et al. | 48/206 |
| 4,411,670 | 10/1983 | Marion et al. | 48/197 R |
| 4,525,176 | 6/1985 | Koog et al. | 48/197 R |
| 4,615,284 | 10/1986 | Pollmann et al. | 110/343 |
| 4,654,164 | 3/1987 | Najjar | 252/373 |
| 4,657,702 | 4/1987 | Vasconcellos et al. | 252/373 |
| 4,668,429 | 5/1987 | Najjar | 48/197 R |
| 4,788,003 | 11/1988 | Najjar et al. | 252/373 |
| 4,801,440 | 1/1989 | Najjar et al. | 252/373 |
| 4,803,061 | 2/1989 | Najjar et al. | 252/373 |
| 4,857,229 | 8/1989 | Najjar et al. | 252/373 |
| 4,952,380 | 8/1990 | Najjar et al. | 252/373 |
| 4,995,193 | 2/1991 | Soga et al. | 48/DIG. 2 |
| 5,338,489 | 8/1994 | Jung et al. | 252/373 |

*Primary Examiner*—Timothy McMahon

*Attorney, Agent, or Firm*—Kenneth R. Priem; Richard A. Morgan

[57] ABSTRACT

A method facilitating the deslagging of a partial oxidation reactor used to produce syngas is disclosed. The slag comprises vanadium trioxide and a siliceous material that accumulate on the interior walls of the partial oxidation reactor as a byproduct of the syngas production. The deslagging is accomplished by controlled oxidation, wherein the vanadium to glass weight ratio is maintained to at least about 3:2, operating the reactor at a temperature of at least about 2000° F, and maintaining controlled oxidation conditions sufficient to convert the vanadium trioxide in the slag to vanadium pentoxide.

21 Claims, 2 Drawing Sheets

EQUILIBRIUM OXYGEN PARTIAL PRESSURE ABOVE $V_2O_5$

VANADIUM ADDITION TO PETROLEUM COKE SLURRIES TO FACILITATE DESLAGGING FOR CONTROLLED OXIDATION

BACKGROUND OF THE INVENTION

1. Field of the Invention

This invention relates to the addition of small amounts of a vanadium containing material to the petroleum based feedstocks used for partial oxidation reactions. The vanadium additions facilitate deslagging of the partial oxidation reactor.

2. Description of the Prior Art

Petroleum based feedstocks include impure petroleum coke and other hydrocarbonaceous materials, such as residual oils and byproducts from heavy crude oil. These feedstocks are commonly used for partial oxidation reactions that produce mixtures of hydrogen and carbon monoxide gases, commonly referred to as "synthesis gas" or simply "syngas." Syngas is used as a feedstock for making a host of useful organic compounds and can also be used as a clean fuel to generate power. The syngas feedstocks generally contain significant amounts of contaminants such as sulfur and various metals such as vanadium, nickel and iron.

The charge, including feedstock, free-oxygen-containing gas and any other materials, is delivered to the partial oxidation reactor. The partial oxidation reactor is also referred to as a "partial oxidation gasifier reactor" or simply a "reactor" or "gasifier," and these terms are used interchangeably throughout the specification.

Any effective means can be used to feed the feedstock into the reactor. Generally, the feedstock and gas are added through one or more inlets or openings in the reactor. Typically, the feedstock and gas are passed to a burner which is located in the reactor inlet. Any effective burner design can be used to assist the addition or interaction of feedstock and gas in the reactor, such as an annulus-type burner described in U.S. Pat. No. 2,928,460 to Eastman et al., U.S. Pat. No. 4,328,006 to Muenger et al. or U.S. Pat. No. 4,328,008 to Muenger et al.

Alternatively, the feedstock can be introduced into the upper end of the reactor through a port. Free-oxygen-containing gas is typically introduced at high velocity into the reactor through either the burner or a separate port which discharges the oxygen gas directly into the feedstock stream. By this arrangement the charge materials are intimately mixed within the reaction zone and the oxygen gas stream is prevented from directly impinging on and damaging the reactor walls.

Any effective reactor design can be used. Typically, a vertical, cylindrically shaped steel pressure vessel can be used. Illustrative reactors and related apparatus are disclosed in U.S. Pat. No. 2,809,104 to Strasser et al., U.S. Pat. No. 2,818,326 to Eastman et al., U.S. Pat. No. 3,544,291 to Schlinger et al., U.S. Pat. No. 4,637,823 to Dach, U.S. Pat. No. 4,653,677 to Peters et al., U.S. Pat. No. 4,872,886 to Henley et al., U.S. Pat. No. 4,456,546 to Van der Berg, U.S. Pat. No. 4,671,806 to Stil et al. , U.S. Pat. No. 4,760,667 to Eckstein et al., U.S. Pat. No. 4,146,370 to van Herwijner et al. , U.S. Pat. No. 4,823,741 to Davis et al., U.S. Pat. No. 4,889,540 Segerstrom et al., U.S. Pat. No. 4,959,080 to Sternling, and U.S. Pat. No. 4,979,964 to Sternling. The reaction zone preferably comprises a downflowing, free-flow, refractory-lined chamber with a centrally located inlet at the top and an axially aligned outlet in the bottom.

The refractory can be any effective material for a partial oxidation reactor. The refractory can be prefabricated and installed, such as fire brick material, or may be formed in the reactor, such as plastic ceramic. Typical refractory materials include at least one or more of the following: metal oxides, such as chromium oxide, magnesium oxide, ferrous oxide, aluminum oxide, calcium oxide, silica, zirconia, and titania; phosphorus compounds; and the like. The relative amount of refractory materials may be any effective proportion.

The partial oxidation reaction is conducted under any effective reaction conditions, sufficient to convert a desired amount of feedstock to syngas. Reaction temperatures typically range from about 900° C. to about 2,000° C., preferably from about 1,200° C. to about 1,500° C. Pressures typically range from about 1 to about 250, preferably from about 10 to about 200, atmospheres. The average residence time in the reaction zone generally ranges from about 0.5 to about 20, and normally from about 1 to about 10, seconds.

The partial oxidation reaction is preferably conducted under highly reducing conditions for syngas production. Generally, the concentration of oxygen in the reactor, calculated in terms of partial pressure, during partial oxidation is less than about $10^{-5}$, and typically from about $10^{-12}$ to about $10^{-8}$ atmospheres.

The partial oxidation of impure petroleum coke or other suitable petroleum based feedstock that has contaminant materials produces a slag byproduct that can collect and build up deposits on the inside surface of the reactor or at the lower throat of the reactor and the reactor outlet to the extent that blockage can occur and effective partial oxidation is prevented. Therefore, periodic shutdown of the partial oxidation reactor becomes necessary to remove slag, in an operation commonly referred to as "controlled oxidation" or "deslagging." Controlled oxidation conditions in the partial oxidation reactor are used to fluidize or melt the slag so that it can be removed by flowing out of the reactor, and thereby enable the reactor to be restored to partial oxidation operation.

Petroleum based feedstocks such as impure petroleum coke generally contain vanadium as a primary ash constituent along with various amounts of alumina, silica, and calcium. During the partial oxidation reaction to form syngas, the alumina, silica and calcium constituents of the petroleum coke feedstock tend to form a siliceous glass matrix that surrounds the vanadium, which exists primarily in the form of vanadium trioxide ($V_2O_3$) crystals.

The ash particles formed as a byproduct of the syngas reaction will impinge and adhere to the inside surface walls of the reactor and, depending on the ash fusion temperature, accumulate in the form of slag, or flow out of the reactor.

Thus, the slag is essentially fused mineral matter, a by-product of the slag-depositing material in the petroleum based feedstock. Slag can also contain carbon in the form of char, soot, and the like.

The composition of the slag will vary depending on the type of slag-depositing material in the petroleum based feedstock, the reaction conditions and other factors influencing slag deposition. Typically, slag is composed of oxides and sulfides of slagging elements. For example, slag derived from impure petroleum coke or resid usually contains siliceous material, such as glass and crystalline structures such as wollastinite, gehlenite and anorthite; vanadium oxide, generally in the trivalent state, $V_2O_3$; spinel having a composition represented by the formula $AB_2O_4$ wherein A is iron and magnesium and B is aluminum, vanadium and chromium; sulfides of iron and/or nickel; and metallic iron and nickel.

Slag having a melting temperature below the reactor temperature can melt and flow out of the reactor as molten slag. Since $V_2O_3$ has a high melting point of about 1970° C. (3578° F.), greater amounts of $V_2O_3$ in the slag will cause the melting temperature of the slag to increase.

Slag which has higher melting temperature than the reactor temperature generally builds up solid deposits in the reactor, typically adhering to the surfaces of the refractory material lining the reactor. Slag deposits increase as the partial oxidation reaction proceeds. The rate that slag accumulates can vary widely depending on the concentration of slag-depositing metal in the feedstock, reaction conditions, use of washing agents, reactor configuration and size, or other factors influencing slag collection.

The amount of slag accumulation eventually reaches a level where slag removal from the reactor becomes desirable or necessary. Although slag removal can be conducted at any time, the partial oxidation reaction is usually continued for as long as possible to maximize syngas production.

SUMMARY OF THE INVENTION

In accordance with the present invention, the removal of slag from a partial oxidation reactor during controlled oxidation conditions can be facilitated by maintaining the gasifier at a temperature that is at least at the initial melting temperature of the siliceous glass material component of the slag, and by controlling the vanadium to glass ratio in the slag to maximize the exposure of vanadium trioxide, $V_2O_3$, to oxidizing conditions sufficient to convert the high melting $V_2O_3$ slag component to the lower melting vanadium pentoxide, $V_2O_5$, phase which then destroys the siliceous glass matrix, thereby allowing the partial oxidation gasifier reactor to be deslagged below the gasification temperature.

DESCRIPTION OF THE PREFERRED EMBODIMENTS

Figure 1:
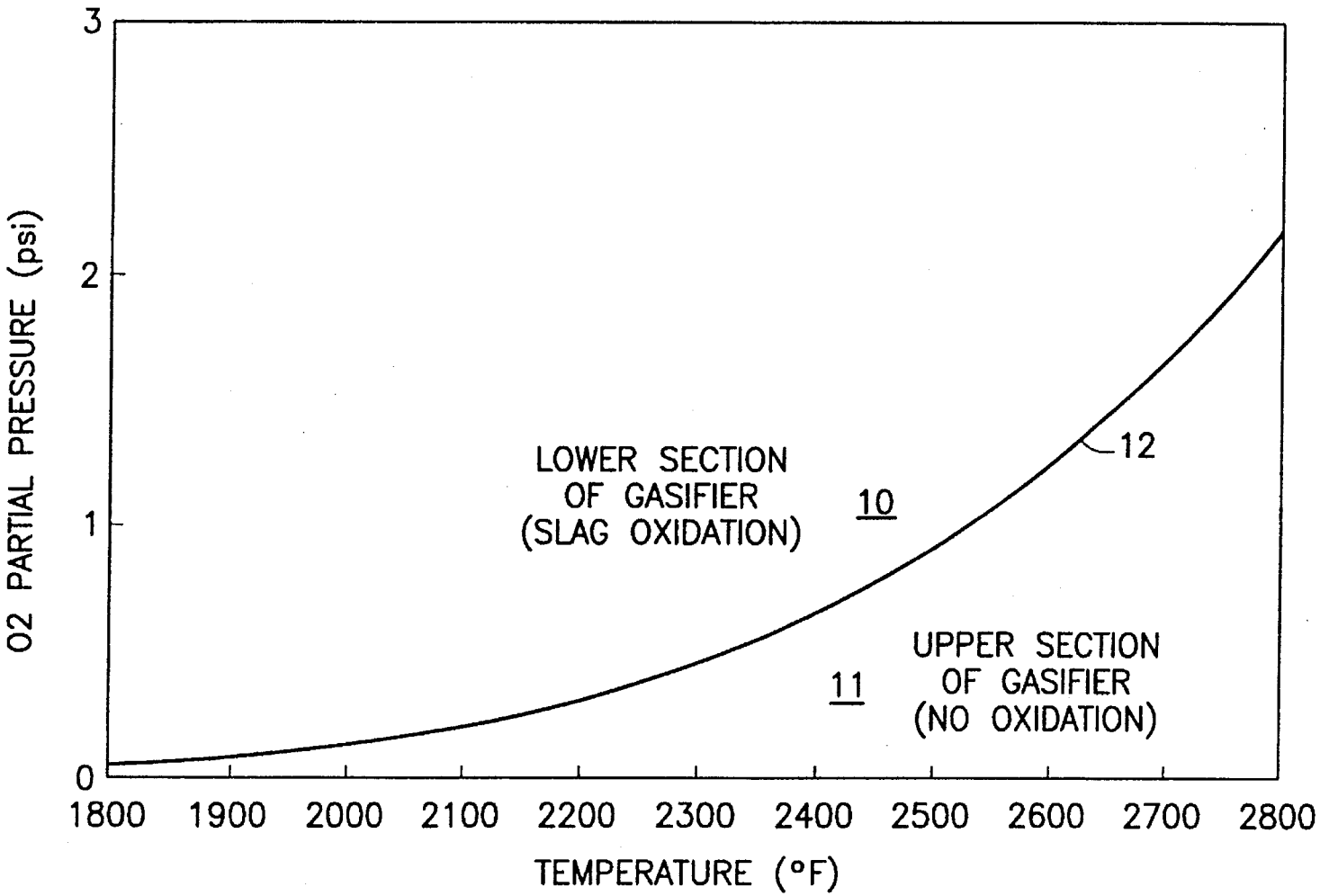
FIG. 1 is an equilibrium partial pressure diagram showing the minimum oxygen partial pressure required to convert $V_2O_3$ to $V_2O_5$.

It has been found that the addition of small amounts of a vanadium containing material to petroleum based feedstocks undergoing partial oxidation in a partial oxidation reactor will enhance slag removal during the deslagging operation of the reactor under controlled oxidation conditions.

During the partial oxidation gasification reaction of a petroleum based feedstock such as coke, the vanadium present in the coke feedstock forms $V_2O_3$ crystals while the alumina, silica and calcium form a siliceous glass, each of which can exit the reactor as ash particles or impinge upon the inner walls of the reactor and accumulate thereon as slag, depending on the ash fusion temperature. The siliceous glass material in the slag forms a matrix or phase that surrounds the vanadium trioxide crystals.

The introduction of oxygen into the partial oxidation reactor during controlled oxidation oxidizes $V_2O_3$ to $V_2O_5$. This reaction has an effect on the siliceous glass material that enables the slag to fluidize and flow out of the reactor. The $V_2O_5$ attacks and breaks the surrounding interlocking siliceous glass phase into small discrete spherical particles that will flow out of the reactor with the melted vanadium slag below normal gasification temperatures of about 2100° to 3200° F.

In order for the action of the vanadium pentoxide in attacking the siliceous glass portion of the slag to be effective, the vanadium to glass ratio must be carefully controlled. As the relative glass to vanadium ratio increases, the glass phase will inhibit the oxidation of $V_2O_3$ crystals and form an interlocking network of siliceous crystals that prevents the slag from flowing. The amount of $V_2O_5$ that is generated is not sufficient to break down the siliceous matrix.

If the coke ash is too low in vanadium content, then vanadium or a vanadium rich material must be added to the coke feedstock undergoing partial oxidation to increase the vanadium to glass ratio. The vanadium can be obtained from soot generated during oil gasification, char from other coke gasifiers, vanadium bought on the open market, or any other vanadium rich material.

The vanadium to glass ratio in the slag generally can vary from about 7:1 to about 1:2, by weight, respectively. A minimum weight ratio of vanadium to glass of about 2:1 is needed to insure the destruction of the siliceous glass phase during controlled oxidation. The vanadium content of the slag can vary from about 60 to 80 weight percent. The siliceous glass content of the slag can very from about 20 to 30 weight percent.

Below a vanadium to glass ratio of about 3:2 the slag becomes less viscous and will begin to flow into the lower throat of the reactor during gasification and can solidify, causing obstruction, due to the rapid change in temperature gradient and lower temperature at the reactor throat. Below the 3:2 vanadium to glass ratio, addition of vanadium should be made to increase the ratio to at least 2:1 . Because the amount of ash in most petroleum based feedstocks is low, the amount of added vanadium needed to change the vanadium to glass ratio in the slag is small. For example, for a typical petroleum based feed, vanadium additions of about 0.01 to 20 weight %, preferably about 0.05 to 3.0 weight %, more preferably about 0.1 to 2.5 weight %, and most preferably about 0.5 to 2.0 weight % is sufficient to increase the vanadium to glass ratio to at least 2:1.

To obtain maximum deslagging rates, the gasifier temperature during controlled oxidation should operate at about the initial melting temperature of the siliceous glass material, generally about 2000° F. to 2500° F. and preferably about 2200° F. to 2300° F.

In one embodiment of the invention, slag can be allowed to accumulate in the reactor until the diameter of the lower throat begins to decrease due to slag buildup. The partial oxidation gasification reaction would then be stopped and controlled oxidation conditions would be introduced into the reactor in order to remove the slag.

During the controlled oxidation reaction, the partial pressure of oxygen is increased in the gasifier to convert the high melting temperature $V_2O_3$ phase into the lower melting temperature $V_2O_5$ phase. Any free-oxygen-containing gas that contains oxygen in a form suitable for reaction during the partial oxidation process can be used. Typical free-oxygen-containing gases include one of more of the following: air; oxygen-enriched air, meaning air having greater than 21 mole percent oxygen; substantially pure oxygen, meaning greater than 95 mole percent oxygen; and other suitable gas. Commonly, the free-oxygen-containing gas contains oxygen plus other gases derived from the air from which oxygen was prepared, such as nitrogen, argon or other inert gases.

The proportion of petroleum based feedstock to free-oxygen-containing gas, as well as any optional components, can be any amount effective to make syngas. Typically, the atomic ratio of oxygen in the free-oxygen-containing gas to carbon, in the feedstock, is about 0.6 to about 1.6, preferably about 0.8 to about 1.4. When the free-oxygen-containing gas is substantially pure oxygen, the atomic ratio can be about 0.7 to about 1.5, preferably about 0.9. When the oxygen-containing gas is air, the ratio can be about 0.8 to about 1.6, preferably about 1.3.

FIG. 1 is an equilibrium oxygen partial pressure temperature diagram at 1 atmosphere that shows the oxygen partial pressure necessary to convert $V_2O_3$ to $V_2O_5$ and the temperature parameters which enable the reactor to operate in two different regimes simultaneously. As shown in FIG. 1, by the operating point 10 that is above and to the left of the equilibrium curve 12, the oxygen partial pressure is sufficient to oxidize the $V_2O_3$ in the lower section of the reactor so that the resulting $V_2O_5$ liquifies at the operating temperature. The partial pressure of oxygen is generally gradually increased during controlled oxidation from about 2.0% to about 10% at a pressure of about 1–200 atmospheres in the partial oxidation reactor, for example, over a period of 1 to 24 hours.

Other materials may optionally be added to the gasification feedstock or process. Any suitable additives can be provided, such as fluxing or washing agents, temperature moderators, stabilizers, viscosity reducing agents, purging agents, inert gases or other useful materials.

One advantage of the inventive process is that the impure petroleum coke can be gasified to produce syngas and the reactor can then be deslagged by using controlled oxidation, which is less expensive than using a washing agent, or by waiting for the reactor to cool down and then mechanically deslagging. In addition, because the slag can be reclaimed, solid handling is decreased, and higher carbon conversion is achieved.

The calcium content in the coke ash is also important, because lower amounts of calcium will increase the slag viscosity during gasification, thus inhibiting flow or creep. Higher amounts of calcium will increase the rate of controlled oxidation by allowing the siliceous glass to break down quicker. Therefore, the amount of calcium in the slag should be sufficient to lower the glass melting point to about 2300° F.–2500° F.

Consequently, for coke feedstocks that have less than about 10 weight % of CaO in the glass forming compounds such as $Al_2O_3$, $SiO_2$, CaO+MgO, and FeO, small additions on the order of about 0.05–1, preferably about 0.1–0.5, and most preferably about 0.2–0.4 pounds of calcium per ton of petroleum based feed can be beneficial in increasing the deslagging rates by allowing the glass to break down quicker at lower temperatures. This in turn improves refractory life by reducing exposure time to $V_2O_5$. The calcium can be in the form of calcium carbonate, calcium oxide, or other equivalent compounds.

In the examples that follow and throughout the specification, all parts and percentages are by weight, unless otherwise noted.

EXAMPLE 1

Figure 2:
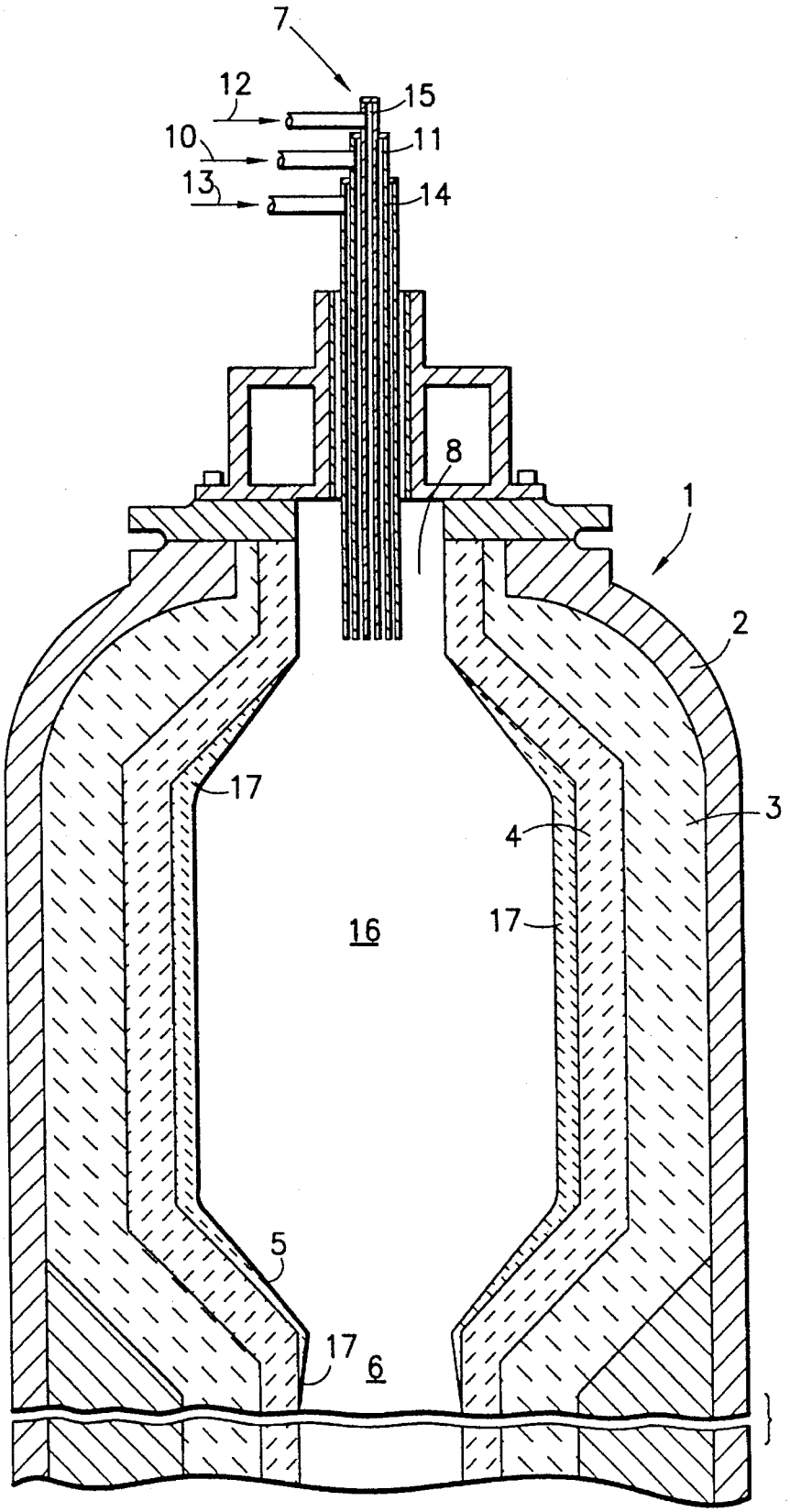
FIG. 2 is a cross section of a partial oxidation reactor.

Two partial oxidation gasifiers, Gasifier A and Gasifier B, each having the configuration shown in FIG. 2, were operated in a partial oxidation mode and shut down, allowing slag deposits that accumulated during partial oxidation to cool. In FIG. 2, the partial oxidation reactor 1 is made of a cylindrically shaped steel pressure vessel 2 lined with refractories 3 and 4. The bottom refractory 5 slopes to throat outlet 6. Burner 7 passes through inlet 8 at the top of the reactor 1. The reactor is also equipped with a pyrometer and thermocouples, not shown, to monitor reactor temperature at the top, middle and bottom of the reaction chamber. For partial oxidation, the feedstock is fed through line 10 to an inner annular passage 11 in burner 7. Free-oxygen-containing gas is fed through lines 12 and 13 to central and outer annular passages 14 and 15, respectively. The partial oxidation reaction is conducted at temperatures of from about 1200° C. (2192° F.) to about 1500° C. (2732° F.) and at pressures of from about 10 to about 200 atmospheres. The feedstock reacts with the gas in reaction chamber 16 making synthesis gas and by-products including slag which accumulates on the inside surface 17 of the reactor 1 and outlet 6. Synthesis gas and fluid by-products leave the reactor through outlet 6 to enter a cooling chamber or vessel, not shown, for further processing and recovery.

The non-gaseous by-product slag impinged upon and adhered to the inside surfaces of the reactor. The slag obtained from Gasifier A was classified as a high vanadium, moderately siliceous slag having approximately 20% silicates. The slag obtained from Gasifier B was classified as a low vanadium, high siliceous slag having approximately 42% silicates.

The Gasifier B slag did not become fluid when oxidized at a temperature of 2400° F. under air. The Gasifier A slag fluidized under air at 2200° F.

2"×2"×2" samples of unoxidized slag were removed from Gasifier A and Gasifier B, and were oxidized at 1925° F. and 2400° F. Following cooling to 70° F. temperature, the samples were prepared for scanning electron microscope (SEM) analysis. The SEM was equipped with an energy dispersive x-ray spectrometer (EDS). Standardless quantitative analysis using a PROZA correction routine was used for the chemical analysis. Additional phase analysis was done using reflective light microscopy.

Tables 1 and 2 show that the slag from Gasifiers A and B undergo similar reactions when going from a reducing to an oxidizing atmosphere.

Nickel present in the form of nickel sulfide combined with alumina in the glass phase to form spinels. The calcium, iron, magnesium, molybdenum or similar +2 valance state metals from the glass and oxidized phases, formed $MV_2O_6$ phases (wherein M =Fe, Ca, Mg, Mo, etc.) which were the predominant carrier fluid phase in the oxidized slag. The glass was converted to more crystallized phases enriched with silica.

Depending on the temperature of oxidation (e.g. 1925 and 2400° F.), the degree of change in the glass phase varied. Analysis of the B slag indicated that at 1925° F. the vanadium oxide did not completely destroy the glass phase, but rather it left a network of alumina-silica and silica-rich laths that inhibited the slag from flowing. At 2400° F., the laths became small spherical crystals that were not interconnected, and therefore could be washed from the reactor by the flowing $MV_2O_6$ slag. Nickel sulfide in the slag formed nickel alumina spinels at the 1925° F. and 2400° F. temperatures.

TABLE 1

| | Chemical Analysis (SEN-EDX: wt %) GASIFIER A | | | | | | | | |
|---|---|---|---|---|---|---|---|---|---|
| | Mg | Al | Si | S | Ca | V | Cr | Fe | Ni |
| Reduced | 2.3 | 3.3 | 7.2 | 9.1 | 6.3 | 41.8 | | 20.8 | 7.6 |
| Oxidized | 3.2 | 5.1 | 10.4 | 0.2 | 9.7 | 46.6 | 0.7 | 17.6 | 6.2 |
| 1925° F. | | | | | | | | | |
| Bulk | 1.3 | 0.5 | 13.3 | 0 | 7.6 | 54.7 | 0 | 17.6 | 4.4 |
| Bulk | 1.1 | 1.1 | 11.9 | 0 | 5.1 | 37.1 | 0.7 | 31 | 11.5 |
| Phase 1 tabular crystals | 5.1 | 0 | 0.3 | 0 | 3.4 | 53.1 | 0 | 33.8 | 3.2 |
| Phase 2 spinels | 1.5 | 6.4 | 0.3 | 0 | 0 | 3.2 | 0.3 | 59.3 | 28.8 |
| Phase 3 laths | 0.3 | 0 | 84.2 | 0 | 0.3 | 12.7 | 0 | 0.9 | 0 |
| Phase 4 laths | 1.6 | 0 | 0 | 0 | 20.6 | 74.3 | 0.9 | 1.4 | 1.1 |
| 2400° F. | | | | | | | | | |
| Bulk | 0.6 | 4.8 | 12.8 | 0 | 6.7 | 49.5 | X | 18.2 | 6.1 |
| Phase 1 tabular crystal | 2.6 | 1.2 | 0 | 0 | 0.1 | 56.9 | X | 35.1 | 3.3 |
| Phase 2 spinets | 2.7 | 23.9 | 3.6 | 0 | 0.2 | 3.8 | X | 31.8 | 33.6 |
| Phase 3 spheres | 0.2 | 3.1 | 73.3 | 0 | 2.4 | 12.9 | X | 2.6 | 0.4 |
| Phase 4 laths | 0.2 | 0 | 0 | 0 | 22.4 | 72.9 | X | 4.1 | 0 |

TABLE 2

| | Chemical Analysis (SEN-EDX: wt %) GASIFIER B | | | | | | | | |
|---|---|---|---|---|---|---|---|---|---|
| | Mo | Al | Si | S | Ca | V | Cr | Fe | Ni |
| Reduced (Layer 1) | X | 14.7 | 9.3 | 11.4 | 0.6 | 36.4 | X | 11.5 | 15.9 |
| Reduced (Layer 2) | X | 2.1 | 1.6 | 3.2 | 0.4 | 81.6 | 0 | 3.9 | 6.2 |
| Oxidized | X | 14.1 | 4.1 | 1.7 | 0 | 59.8 | 0 | 5.6 | 14.1 |
| 1925°F. | | | | | | | | | |
| Bulk | 9.23 | 13.9 | 16.2 | 0 | 0 | 35.1 | 0.4 | 8.6 | 15.3 |
| Phase 1 spinet | 0 | 28.7 | 0.5 | 0 | 0 | 3.1 | 0.2 | 17.9 | 49.4 |
| Phase 2 tabular crystals | 20.9 | 2.4 | 0 | 0 | 0 | 34.9 | 0 | 18.3 | 18.7 |
| Phase 3 laths | 11.4 | 4.2 | 0.9 | 0 | 0 | 77.3 | 0 | 2.1 | 0.6 |
| Phase 4 lath | 1.9 | 0 | 85.7 | 0 | 0 | 9.6 | 0 | 0.8 | 1.7 |
| Phase 5 lath | 0.7 | 33.9 | 42.5 | 0 | 0 | 19.9 | 0 | 0.5 | 1.1 |
| 2400° F. | | | | | | | | | |
| Bulk | 10.1 | 12.9 | 20.4 | 0 | 0.2 | 35.9 | 0 | 7.9 | 11.5 |
| Bulk | 6.9 | 16.2 | 15.8 | 0 | 0.3 | 34.5 | 0 | 9.8 | 15.7 |
| Phase 1 tabular crystals | 17.6 | 0.9 | 0 | 0 | 0 | 37.1 | 0.3 | 20.8 | 18.3 |
| Phase 2 laths | 14.1 | 0.7 | 0.2 | 0 | 0 | 83.6 | 0 | 0.7 | 0.5 |
| Phase 3 hexagonal crystals | 0 | 0 | 97.4 | 0 | 0.6 | 2.1 | 0 | 0 | 0 |
| Phase 4 laths | 3.9 | 42.3 | 22.1 | 0 | 0.2 | 25.1 | 0.4 | 3.7 | 1.8 |
| Phase 5 spinet | 0 | 34.4 | 1.2 | 0 | 0 | 2.7 | 0.2 | 17.5 | 43.6 |

The slag from Gasifier B contained more glass and less vanadium than the slag from Gasifier A, thereby placing the slag from Gasifier B below the 2:1 limit. During gasification, the slag from Gasifier B formed layers that were enriched in siliceous glass. Oxidation of the slag at 1925° F. formed an inter-locking network of alumina-silica crystals that supported the vanadium oxide. Molybdenum and iron vanadates formed interstitial phases between the silicates. At 2400° F., some silica-rich spheres formed, but most appeared to be interlocking. There was no indication that the vanadium oxide was dissolving the silica from the spheres. Therefore even over time the silicate network remained intact and the slag did not flow from the reactor. The formation of a large amount of nickel alumina spinels would also increase the viscosity of the slag if the silica dissolved.

Gasifier B slag, which had high glass content and lower vanadium, did not break down at 2400° F., whereas the slag in Gasifier A, with approximately half the glass content, broke down completely at 2200° F. due to the interaction of $V_2O_5$ with glass.

EXAMPLE 2

Cones were formed of synthetic slag-like material having the following composition: a glass phase consisting of 65 weight % $SiO_2$, 20 weight % $Al_2O_3$, 10 weight % CaO, and 5 weight % FeO; with $V_2O_3$: glass ratios of 10:0, 9:1, 4:1, 7:3, 1:1, 3:7 and 0:10. These compositions are tabulated in Table 3.

TABLE 3

| Glass Composition | | | Ratio $V_2O_3$:Glass | Results* |
|---|---|---|---|---|
| Test 1 | | | | |
| $SiO_2$ | - | 65 wt. % | 9:1 (Run 1) | Cone completely destroyed |
| $Al_2O_3$ | - | 20 | 8:2 (Run 2) | Cone mostly destroyed |
| CaO | - | 10 | 7:3 (Run 3) | Cone partially destroyed |
| FeO | - | 5 | 6:4 (Run 4) | Cone was glazed and intact |

TABLE 3-continued

| Glass Composition | | | Ratio $V_2O_3$:Glass | Results* |
|---|---|---|---|---|
| Test 2 | | | | |
| $SiO_2$ | - | 65 wt.% | 7:3 | Cone partially destroyed |
| $Al_2O_3$ | - | 25 | | |
| CaO | - | 10 | | |
| Test 3 | | | | |
| $SiO_2$ | - | 65 wt.% | 7:3 | Cone intact |
| $Al_2O_3$ | - | 30 | | |
| CaO | - | 5 | | |
| Test 4 | | | | |
| $SiO_2$ | - | 20 wt.% | 7:3 | Cone partially destroyed |
| $Al_2O_3$ | - | 50 | | |
| CaO | - | 30 | | |
| Test 5 | | | | |
| $SiO_2$ | - | 55 wt.% | 7:3 | Cone destroyed |
| $Al_2O_3$ | - | 0 | | |
| CaO | - | 45 | | |

*Results based on visual appearance and SEM analysis

A Leco ash deformation unit was used to study the effects of changing the ratio of vanadium oxide to glass ($FeO+CaO+SiO_2+Al_2O_3$) on: i) the initial deformation temperature of a series of vanadium rich synthetic slags under gasifier conditions, and ii) the flow characteristics of the synthetic slag during oxidation. The glass composition was held constant during each individual test run, and two different glass compositions were used.

The experiments were conducted under a 60:40 mixture of $CO:CO_2$ during heat-up to keep the vanadium reduced to the +3 valence state. Depending on the test being conducted the $CO:CO_2$ either: i) remained on during cool down, or ii) after the deformation temperature was obtained, the mixture was turned off and air was allowed to bleed into the unit. After cool down with air, the amount of deformation to the cones was noted and samples prepared for SEM analysis.

To determine the effects of the glass composition on the rate of oxidation to the cone, the amounts of $CaO+Al_2O_3+SiO_2$ were changed in the cones having a vanadium oxide to glass ratio of 7:3. The cones were heated to 2800° F., under reducing gas. Air was allowed to enter the unit while the samples cooled down. Following cooling, the samples were visually inspected and mounted for SEM analysis.

Synthetic slag cones containing between 50 and 70 weight % siliceous material deformed under reducing conditions, as shown in Tables 4 and 5. With 80% glass, 20% vanadium oxide, the deformation occurred as low as 2350° F. The initial glass composition determined the deformation point of the slag. Thus, the higher the CaO, the lower the deformation temperature.

TABLE 4

Cone Deformation Testing

COKE
Starting Material — Predicted Melting Point: 2410° F.

| | |
|---|---|
| $Al_2O_3$ | 20% |
| $SiO_2$ | 65% |
| CaO | 10% |
| FeO | 5% |

TABLE 4-continued

Cone Deformation Testing

| $V_2O_3$ | Glass | Initial Temp. | Softening Temp. | Hemispherical Temp. | Fluid Temp. |
|---|---|---|---|---|---|
| 0 | 100 | 2385 | 2411 | 2426 | 2427 |
| 10 | 90 | 2374 | 2397 | 2415 | 2417 |
| 20 | 80 | 2436 | 2484 | 2510 | 2512 |
| 30 | 70 | 2670 | 2800 | 2800 | 2800 |
| 50 | 50 | 2800 | 2800 | 2800 | 2800 |
| 90 | 10 | 2800 | 2800 | 2800 | 2800 |

TABLE 5

Cone Deformation Testing

GLASS
Starting Material — Predicted Melting Point: 2280° F.

| | |
|---|---|
| $Al_2O_3$ | 13.9% |
| $SiO_2$ | 51.2% |
| CaO | 17.9% |
| FeO | 7.8% |
| MgO | 4.1% |
| Other | 5.1% |

| $V_2O_3$ | Glass | Initial Temp. | Softening Temp. | Hemispherical Temp. | Fluid Temp. |
|---|---|---|---|---|---|
| 0 | 100 | 2108 | 2122 | 2141 | 2142 |
| 10 | 90 | 2108 | 2122 | 2141 | 2142 |
| 20 | 80 | 2145 | 2196 | 2340 | 2341 |
| 30 | 70 | 2351 | 2707 | 2800 | 2800 |
| 50 | 50 | 2800 | 2800 | 2800 | 2800 |
| 90 | 10 | 2800 | 2800 | 2800 | 2800 |

Microscopic analysis of the samples indicated that the cones, prior to testing, consisted of a network of vanadium crystals interlocked within glass. These structures were similar to those found in actual slag deposits, except that the vanadium oxide crystals were larger in the sample cones.

During oxidation, synthetic cones having less than 20 weight % siliceous glass content were destroyed. Cones having 30% glass lost material, as was evident by a reduction in size but still retained their shapes. Cones containing over 40 weight % siliceous material remained intact, and did not appear to lose much vanadium oxide.

Microscopic analysis of the cones indicated that the glass phase was breaking up into discrete, siliceous particles during oxidation. These irregular-shaped silicates provided a framework to support the cones once the vanadium oxide converted to vanadium pentoxide ($V_2O_5$).

Cones with higher calcium and lower silica content lost more material during the oxidation than the higher silica content cones. Analysis indicated that most of the calcium appeared to have been removed from the cone by the vanadium during the oxidation process, leaving behind an alumina-rich, vanadium-poor framework. The higher silica content material also contained calcium vanadates in the pores, but the silicate phase remained as irregular shapes in an interlocking framework.

What is claimed is:

1. A method for facilitating the removal of slag from a partial oxidation reactor wherein a petroleum-based feedstock containing a slag-depositing material is partially oxidized with an oxidant gas to produce syngas, and a slag byproduct which comprises vanadium primarily in the form of $V_2O_3$ and a siliceous glass material, and wherein deslagging of the reactor is conducted under controlled oxidation conditions to convert the higher melting $V_2O_3$ component of the slag to lower melting $V_2O_5$, comprising:

(a) controlling the $V_2O_3$: glass weight ratio of the slag in the reactor during partial oxidation to an amount greater than 3:2; and (b) replacing the partial oxidation conditions with controlled oxidation conditions and increasing the partial pressure of the oxidant gas to an amount sufficient to convert the $V_2O_3$ to $V_2O_5$.

2. The method of claim 1, wherein the $V_2O_3$content of the slag varies from about 60 to 80 weight %.

3. The method of claim 1, wherein the siliceous glass content of the slag varies from about 20 to 30 weight %.

4. The method of claim 1, wherein the temperature of controlled oxidation is at least about 2000° F.

5. The method of claim 1, wherein a vanadium containing material is added to the petroleum based feedstock in an amount that varies from about 0.01 to 20 weight % of the petroleum based feedstock.

6. The method of claim 5, wherein the vanadium containing material is selected from the group consisting of soot, char, vanadium, a vanadium oxide, and mixtures thereof.

7. The method of claim 1, wherein the petroleum based feedstock is selected from the group consisting of coke, oil, and mixtures thereof.

8. The method of claim 1, wherein the controlled oxidation is conducted at a temperature that varies from about 2000° F. to 2500° F.

9. The method of claim 8, wherein the controlled oxidation temperature varies from about 2200° to 2300° F.

10. The method of claim 1, wherein a calcium-containing material selected from the group consisting of $CaCO_3$, CaO, and mixtures thereof, is added to the petroleum based feedstock during partial oxidation.

11. The method of claim 1, wherein the oxidant gas comprises oxygen.

12. The method of claim 1, wherein the $V_2O_3$ to glass weight ratio varies from about 7:1 to about 3:2, respectively.

13. A process for making synthesis gas which comprises:

(a) adding a free-oxygen-containing oxidant gas and a petroleum based feedstock containing a slag-depositing material to a reactor with interior walls coated with refractory material;

(b) reacting the feedstock and the free-oxygen-containing oxidant gas under partial oxidation conditions to produce a synthesis gas containing hydrogen and carbon monoxide and a slag byproduct comprising vanadium, primarily in the form of $V_2O_3$, and a siliceous glass material, wherein said synthesis gas exits the reactor through an outlet for recovery, and wherein a portion of the slag accumulates of the reactor walls;

(c) controlling the $V_2O_3$; glass weight ratio of the slag in the reactor during partial oxidation to an amount greater than 3:2; and (d) replacing the partial oxidation conditions with controlled oxidation conditions in the reactor end increasing the partial pressure of the oxidant gas to an amount sufficient to convert the $V_2O_3$ to $V_2O_5$.

14. The process of claim 13, wherein the $V_2O_3$ content of the slag varies from about 60 to 80 weight %.

15. The process of claim 13, wherein the siliceous glass content of the slag varies from about 20 to 30 weight %.

16. The process of claim 13, wherein a vanadium containing material is added to the petroleum based feedstock in an amount that varies from about 0.01 to 20 weight % of the petroleum based feedstock.

17. The process of claim 13, wherein the vanadium containing material is selected from the group consisting of soot, char, vanadium, a vanadium oxide, and mixtures thereof.

18. The process of claim 13, wherein the petroleum based feedstock is selected from the group consisting of coke, oil, and mixtures thereof.

19. The process of claim 13, wherein the controlled oxidation is conducted at a temperature that varies from about 2000° F. to 2500° F.

20. The process of claim 13, wherein the controlled oxidation temperature varies from about 2200° to 2300° F.

21. The process of claim 13, wherein the temperature of controlled oxidation is at least about 2000° F.

* * * * *